United States Patent [19]

Lambert

[11] 3,954,473

[45] May 4, 1976

[54] METHOD OF BLEACHING METALLIC SILVER

[75] Inventor: Ronald F. Lambert, Melrose, Mass.

[73] Assignee: Polaroid Corporation, Cambridge, Mass.

[22] Filed: June 24, 1974

[21] Appl. No.: 482,368

[52] U.S. Cl. ..... 96/60 R; 96/60 BF; 96/61 R; 75/118 P

[51] Int. Cl.[2] ..... G03C 5/32; G03C 5/38; C22B 11/00

[58] Field of Search..... 96/60, 60 BF, 61, 109; 75/101 R, 118, 118 P; 134/2

[56] References Cited

UNITED STATES PATENTS

| | | | |
|---|---|---|---|
| 3,019,108 | 1/1962 | Dershowitz | 96/66 |
| 3,578,449 | 5/1971 | Bloom | 96/66 |
| 3,582,340 | 6/1971 | Kuwabara et al. | 96/61 R |
| 3,594,169 | 7/1971 | Bloom et al. | 96/29 R |
| 3,640,713 | 2/1972 | Buckler et al. | 96/61 R |

*Primary Examiner*—Mary F. Kelley
*Attorney, Agent, or Firm*—Sybil A. Campbell

[57] ABSTRACT

This invention relates to a method of bleaching metallic silver by treating a preformed deposit of metallic silver with a silver complexing agent that forms a silver complex having a log stability constant of $\beta_3 \geq 10^{18}$ in the presence of an electron acceptor. In a preferred embodiment, the silver complexing agent is an organic tertiary phosphine and the electron acceptor is an $n$ or $\pi$ type charge receptor having an electron affinity between 1 and 2 electron volts.

14 Claims, No Drawings

METHOD OF BLEACHING METALLIC SILVER

BACKGROUND OF THE INVENTION

1. Field of the Invention

This invention relates to a new method of "bleaching" deposits of metallic silver, and in a particular aspect, it relates to photographic processes and products employing the same.

2. Description of the Prior Art

It is well-known that precipitated metallic silver produced by reduction from solution may vary in color depending upon the particle size of the silver crystals. For example, the reduction of silver nitrate in aqueous alkaline solution yields so-called high covering power black silver composed of small crystals having a particle size up to about 0.1 micron. Reduction in the absence of alkali yields gray silver having a larger particle size up to about 100 microns. In photographic processes, the silver produced by development of an exposed photosensitive silver halide emulsion, though generally filamentary in nature, also may vary in color. Normally, the image silver obtained by chemical development under alkaline conditions has a relatively high covering power and comprises black silver or a near black form.

Customarily, bleaching of precipitated silver and of developed, i.e., image silver is achieved by treating the metallic silver deposit with an oxidizing agent in the presence of a soluble halide whereby the silver is converted to a pale or colorless silver salt, which, if so desired, may be removed by washing or by converting to a soluble salt, i.e., "fixing" and washed out. Commonly employed for this purpose are bleaching baths comprising potassium ferricyanide and a soluble halide, such as, an alkali metal halide, e.g., potassium bromide wherein the metallic silver is converted to silver bromide crystals according to the following equation:

$$[Fe(\overline{CN})_6] + Ag_o + Br^- \rightarrow [Fe(\overline{CN})_6] + [Ag^+Br^-].$$

Other soluble halides that have been employed include ammonium bromide, potassium iodide and phosphonium iodides.

The present invention is concerned with a method for reducing the covering power of metallic silver which finds particular utility in photography as a bleach for decreasing the optical transmission density of developed, e.g., negative image, silver.

Summary of the Invention

It is, therefore, the primary object of the present invention to provide a method of bleaching deposits of metallic silver, which method is useful in photographic processes.

It is another object of this invention to provide a method of decreasing the covering power, i.e., the optical transmission density of metallic silver deposited in a thin layer.

Other objects of the present invention will in part be obvious and will in part appear hereinafter.

The invention accordingly comprises the processes involving the several steps and the relation and order of one or more of such steps with respect to each of the others, and the compositions possessing the features, properties and the relation of elements which are exemplified in the following detailed disclosure, and the scope of the application of which will be indicated in the claims.

DESCRIPTION OF THE PREFERRED EMBODIMENTS

According to the present invention, it has been found that the covering power of metallic silver deposits may be reduced by contacting the deposit, in the presence of an electron acceptor, with a silver complexing agent capable of forming a silver complex having a log stability constant of $\beta_3 \geqslant 10^{18}$. $\beta_3$ as used herein represents the log formation constant $\log K_1 + \log K_2 + \log K_3$ for silver + ligand.

The present method of bleaching metallic silver is useful in a variety of photographic processes. One of the principal advantages of the present method is its utility in applications where it is desired to bleach silver at a comparatively high pH, since most conventional bleaching systems are not effective at high pH. The bleach method of the present invention may be used to achieve a very rapid, if not substantially instantaneous, reduction in the covering power of a metallic silver deposit at an alkaline pH extending from above about 7 to 14. Moreover, washing of the bleached deposit is unnecessary to obtain a stable product, but if it is desired to wash the bleached deposit, "fixing" is unnecessary since the silver complex formed is soluble in water and readily washed away.

In comparison, prior bleaching systems, such as, those employing potassium iodide or a phosphonium iodide in combination with an oxidizing agent are pH dependent and are useful only in neutral or slightly acidic media, i.e., solutions having a pH of about 7 or below. As discussed above, in these systems, the halide, e.g., iodide reacts with the metallic silver in the presence of the oxidizing agent to form silver iodide. The silver iodide is then converted to a soluble silver complex, e.g., to a silver-hypo complex which is removed by washing. If, instead of removing the complex it is allowed to remain in the photographic image, the instability of the complex to light may in time lead to stains due to printing out of the silver.

In the method of the present invention, the silver complexing agent employed forms a strong silver complex, i.e., a silver complex having a stability $\beta_3 \geqslant 10^{18}$ wherein $\beta$ represents log stability constant. Silver complexing agents found particularly useful in the present invention are organic tertiary phosphines, $R_3P$, wherein the R groups may be the same or different organic radicals and preferably, are aliphatic radicals. The organic tertiary phosphines are used in the presence of an electron acceptor, as discussed below. Preferred tertiary aliphatic phosphines may be represented by the formula, $(R')_x P(R'')_y$, wherein R' is alkyl; R'' is substituted alkyl wherein the substituents are either hydroxyl, amino, amido, sulfonyl, sulfhydryl, carboxyl or any combination thereof; $x$ and $y$ each is an integer 0, 1, 2 or 3; and $x + y$ is 3.

Typical compounds within the latter formula re bis(3-hydroxypropyl)methyl phosphine, tris (3-hydroxypropyl) phosphine, 3-hydroxypropyldimethyl phosphine, bis(3-aminopropyl)methyl phosphine, tris (2-carboxyethyl)phosphine, tris(2-carbamoylethyl)phosphine, 5-(aminoamyl)dimethyl phosphine, bis(2-carboxyethyl)methyl phosphine, and 3-aminopropyldimethyl phosphine. These compounds and their synthesis form the subject matter of copending U.S. patent application Ser. No. 888,024 of Ronald F. Lambert filed Dec. 24, 1969 (now abandoned), a continuation-in-part of U.S. patent application Ser. No. 770,823 filed Oct. 25, 1968 (now abandoned).

The electron acceptor may be atmospheric oxygen or an organic or inorganic oxidizing agent which preferably acts as an *n* or $\pi$ type charge receptor whose electron affinity ($E_A$ in electron volts) should lie preferably between 1 and 2 electron volts. By electron affinity is meant the gain in energy on bringing an electron from infinity to the lowest unoccupied molecular orbital of the species in question. [G. Briegleb, Ang. Chem., 76, 326 (1964) and M. Bailey et al., Nature, 196, 573 (1962)]. Particularly useful electron acceptors are organic oxidizing agents as exemplified by 3-nitrophthalic anhydride, 3-nitrophthalic acid, 2,5-dinitrobenzoic acid, 2,4-dinitrophenylacetic acid, 3-nitro-o-phthalic amide, mellitic acid, mellitic trianhydride, 2-hydroxyphenazine, benzoquinone, dichlorodicyano-p-benzoquinone, tetrachloro-p-benzoquinone, 2,6-dimethyl-p-benzoquinone, pyrazine, p-phenylenediimine and 3,5-di-trifluoromethylbenzoic acid.

The subject method may be carried out in organic or aqueous solution, and preferably is conducted in aqueous medium. It will be appreciated that the silver complexing agent and electron acceptor should be soluble in the particular medium selected and that the silver complex formed also should be soluble in the medium. While the quantities of silver complexing agent and electron acceptor may vary, for example, 1 to 5 moles of complexing agent per mole of electron acceptor, the silver complexing agent and electron acceptor are generally used in substantially equimolar proportions and preferably in substantially excess proportions relative to the quantity of metallic silver.

The following examples show by way of illustration and not by way of limitation the practice of this invention.

Example 1

Metallic silver deposited in a substantially uniform, thin layer was prepared as follows:

A photosensitive element containing, in sequence, a paper support layer; a photosensitive gelatino-silver iodobromide emulsion layer; a layer of reflecting pigment containing titanium dioxide dispersed in gelatin; and a silver-precipitating layer containing collodial gold dispersed in a gelatin matrix to which was added colloidal silica (U.S. Pat. No. 3,595,652), was processed in the dark by spreading between the unexposed photosensitive element and a superposed spreader sheet a thin layer of the following processing composition:

| | |
|---|---|
| Water | 8400.0 cc. |
| Sodium carboxymethyl cellulose | 600.0 g. |
| Sodium sulfite | 675.0 g. |
| Sodium hydroxide | 180.0 g. |
| Potassium thiosulfate | 207.0 g. |
| 4-amino-2,6-dimethylphenol | 180.0 g. |

After approximately 60 seconds, the spreader sheet was removed to reveal an overall, substantially uniform silver deposit in the silver-precipitating layer rendering that layer visually black. The silver deposit in said silver precipitating layer was treated with 3-aminopropyldimethylphosphine [$(CH_3)_2P(CH_2)_3NH_2$], as the silver complexing agent, in the presence of atmospheric oxygen, as the electron acceptor, by applying a 1.0 molar aqueous solution of the phosphine to cover the surface of the silver-precipitating layer and then evaporating the water by drying at room temperature.

The foregoing procedure was repeated using different electron acceptors by adding the compound selected to the aqueous phosphine solution in approximately 1.0 M amounts. The compounds used as the electron acceptor and the clearing times (change in covering power of $Ag_o$) observed are set forth in the following Table. "Clearing Time" represents the time measured between application of the bleaching solution to the black silver layer and the disappearance of black rendering the underlying layer of titanium dioxide visible as determined by visual observation.

TABLE

| Electron Acceptor | Clearing Time (secs.) |
|---|---|
| Atmospheric oxygen | 90 |
| 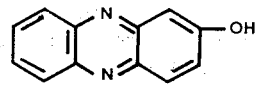 | 60 |
| 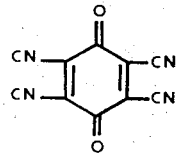 | * inst. |
| 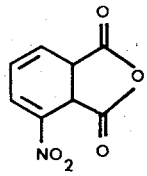 | * inst. |
| 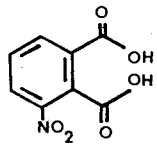 | 10 |
| 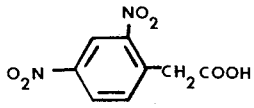 | * inst. |
| 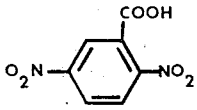 | * inst. |
| 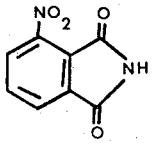 | 30 |

-continued

| Electron Acceptor | Clearing Time (secs.) |
|---|---|
| 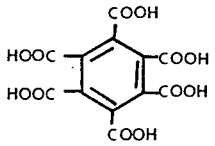 | 60 |
| 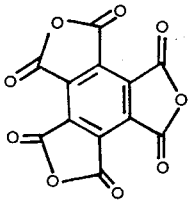 | 30 |

* substantially instantaneously

On the basis of X-ray fluorescence measurements and electron micrographs, it was found that the amount of silver present in the developed photosensitive element was substantially the same after bleaching. In no instance was more than a 5% difference in silver content detected before washing.

Example 2

Example 1 was repeated except that 5-aminopentyldimethylphosphine $[(CH_3)_2P(CH_2)_5NH_2]$ was used as the silver complexing agent with the various electron acceptors. The results obtained were the same.

Example 3

Example 1 was repeated except that the metallic silver deposit treated was a layer of evaporated silver (22 mg. $Ag_o/ft.^2$) deposited on a cellulose triacetate support. The clearing times were substantially the same except that a 30 second induction period for reagent permeability was required. The average optical transmission density (400–700 m$\mu$) measured for the evaporated silver film before bleaching was about 0.8 density unit. After bleaching, the average optical transmission density (400–700 m$\mu$) measured in each instance was about 0.01 density unit.

Example 4

An evaporated silver layer on cellulose triacetate base as used in Example 3 above was treated with an aqueous solution of bis(2-carboxyethyl)methyl phosphine $[CH_3P(CH_2CH_2COOH)_2]$ and 3-nitrophthalic anhydride, both the phosphine and anhydride being present in approximately 1.0M quantities. The clearing time observed was approximately 10 seconds.

Example 5

A silver-coated pigment layer (12 mg. $Ag_o/ft.^2$) was prepared by precipitating metallic silver on a layer of titanium dioxide and calcium carbonate pigments in gelatin binder carried on a polyethylene terephthalate support. The silver-coated pigment layer was treated with an aqueous 1.0 N sodium hydroxide solution containing approximately 1.0 M. quantities of 3-aminopropyl dimethyl phosphine and 2-hydroxyphenazine by applying the solution to cover the surface of the silver-coated layer and then evaporating the aqueous medium. The clearing time observed was about 60 seconds and the content of silver after treatment but before washing, as determined by X-ray fluorescence, was approximately 11 mg. $Ag_o/ft.^2$. The average optical transmission density of the silver layer before and after treatment was 0.6 and 0.01 density unit, respectively.

When the experiment was repeated using dichlorodicyanobenzoquinone and 3-nitrophthalic anhydride, respectively, essentially instantaneous clearing times were observed.

Example 6

A photosensitive element comprising a relatively high speed orthochromatic silver halide emulsion coated on a transparent cellulose triacetate support was totally exposed, i.e., a maximum density overall exposure, and developed with a processing solution of the type disclosed in U.S. Pat. No. 2,662,822 containing silver-precipitating nuclei. The composition was applied by spreading in a layer about 0.003 inch thick between the photoexposed element and a superposed spreader sheet. After about 1 minute, the spreader sheet was stripped from the photosensitive element together with the solid residue of the layer of the processing composition which adhered to the surface of the spreader sheet. No density was observed in the layer of processing composition adhered to the spreader sheet.

Without washing, the developed silver halide emulsion layer was treated with a 1.0M aqueous solution of 3-aminopropyldimethyl phosphine. The oxidized developing agent (p-benzoquinone) remaining in the emulsion layer was used as the electron acceptor.

The developed silver halide layer was converted to a substantially transparent layer in approximately 180 seconds. The optical transmission densities before and after bleaching of the layer were 2.76 and 0.1 density units, respectively.

Example 7

A Polaroid Land Type 107 film unit comprising a photosensitive element and an image-receiving element was processed, without photoexposure, by spreading a layer of aqueous alkaline processing solution between the unexposed silver halide emulsion of the photosensitive element and the silver-precipitating layer of the superposed image-receiving element. After about 15 seconds, the image-receiving element was stripped from the photosensitive element to reveal an overall, substantially uniform silver deposit in the silver-precipitating layer rendering that layer visually black.

The amount of silver deposited as determined by X-ray fluorescence was about 40 mg/ft$^2$.

After washing the silver deposit in the silver precipitating layer by wiping with a wet sponge, 0.5 cc of an aqueous 1.0 M solution of tris(3-hydroxypropyl)phosphine was spread over the surface of the deposit using a glass rod followed by 0.5 cc. of an aqueous 1.0 M solution of 3-carboxy-5-nitrobenzotrifluoride applied in the same manner. The phosphine and benzotrifluoride solutions were prepared by dissolving the respective reagents in water at a concentration of 1.0 M and then adding sodium carbonate to each to a pH of about 9.5

Bleaching of the silver deposit was complete in about 3 minutes. The bleached specimen was then washed with water, and it was determined by X-ray fluorescence that no silver remained in the silver-precipitating layer.

The above experiment was repeated, and after bleaching was complete, the excess fluid was drained from the silver-precipitating layer. Without washing with water, it was attempted to reduce silver ion in the silver-precipitating layer with a strong reducing agent by applying a 1.0 M solution of sodium borohydride. However, no reduction of silver ion was observed with sodium borohydride or when the experiment was repeated using a 3% solution (by weight) of tetramethyl reductic acid in aqueous potassium hydroxide (pH 11.2).

Example 7 also was repeated by substituting potassium thiosulfate for the tris-(3-hydroxypropyl)phosphine as a substitute for the phosphine. No bleaching of the black silver deposit was observed after 15 minutes using this complexing aent.

Example 8

Example 7 was repeated except that the solution of silver complexing agent was an aqueous 5.0 M solution of bis(2-carbamoylethyl)methyl phosphine. Bleaching of the black silver deposit was complete in 1 minute, and the bleached material could not be reduced with sodium borohydride solution or with tetramethylreductic acid solution.

Though the subject method of bleaching metallic silver finds utility in a variety of applications, it is particularly useful in photography, for example, in bleaching image, i.e., developed, silver. One such application is the removal of developed silver to leave a dye image; the ability of the silver bleaching compositions of this invention to remove silver without adverse effect upon given image dyes may be readily determined by routine testing. In certain photographic applications, the developing agent in its oxidized form remaining in contact with the developed image silver may be used as the electron acceptor by simply treating the photosensitive layer containing the image silver and oxidized developer with the selected silver complexing agent. It is not necessary to use another electron acceptor but one or more additional electron acceptors may be employed, if so desired. For example, where the developed silver treated with the silver complexing agent is exposed to the atmosphere, atmospheric oxygen may be used as an additional electron acceptor, or the additional organic or inorganic oxidizing agent may be added to the system in the photographic processing composition and/or in the photographic product. It will be appreciated that the particular electron acceptor or combination of electron acceptors may be readily selected to provide the bleaching rate desired.

It should be noted that the silver bleaching method of the present invention is useful over a wide pH range, including comparatively high pH levels, as distinguished from most bleaching processes which require an acidic pH. The present invention may also be used to recover silver from unwanted photographic materials. Yet another application of the present invention is to bleach and remove optical filter layers comprising silver, such as the silver layer used as a yellow filter layer in certain types of color films.

In still another embodiment, the complexing agent may be used to effect both silver bleaching and removal of unexposed silver halide so that bleaching and fixing may be accomplished in a single step. As an illustration, the organophosphines comprising the preferred silver complexing agents of the present invention are useful as silver halide solvents for complexing unexposed silver halide in both conventional "tray" photographic processes and in diffusion transfer processes as disclosed and claimed in U.S. Pat. Nos. 3,578,449 and 3,594,169. By utilizing these silver complexing agents and an electron acceptor in the appropriate amounts, the silver halide in the unexposed areas of a developed photosensitive emeulsion may be "fixed" simultaneously with bleaching of the developed negative image silver to leave a dye image.

As previously employed in diffusion transfer processes, the organophosphine silver halide solvent is involved in a competing reaction with the silver halide developing agent rather than being applied to a preformed metallic silver deposit as in the bleaching method of the present invention. Subsequent to processing and separation of the photosensitive and image-receiving elements, the processing composition remaining in contact with the image-receiving element has no noticeable effect on the appearance of the silver transfer image. Apparently, the small amount of organophosphine silver halide solvent and other reagents in the processing composition residue become inert upon drying of the image-receiving layer.

Since certain changes may be made in the above process without departing from the scope of the invention herein involved, it is intended that all matter contained in the above description shall be interpreted as illustrative and not in a limiting sense.

What is claimed is:

1. A method of bleaching metallic silver present in a developed photosensitive silver halide element which comprises treating said metallic silver with an aliphatic tertiary organic phosphine in the presence of an electron acceptor selected from 3-nitrophthalic anhydride, 3-nitrophthalic acid, 2,5-dinitrobenzoic acid, 2,4-dinitrophenylacetic acid, 3-nitro-o-phthalic amide, mellitic acid, mellitic trianhydride, 2-hydroxyphenazine, benzoquinone, dichlorodicyano-p-benzoquinone, tetrachloro-p-benzoquinone, 2,6-dimethyl-p-benzoquinone, tetracyano-p-benzoquinone, pyrazine, p-phenylenediimine, 3,5-trifluoromethyl benzoic acid, and 3-carboxy-5-nitrobenzotrifluoride at a pH above 7, said phosphine and electron acceptor being used in equimolar proportions and in substantially excess proportions relative to the quantity of said metallic silver.

2. A method as defined in claim 1 wherein said phosphine is 3-aminopropyldimethylphosphine.

3. A method as defined in claim 1 wherein said phosphine is 5-aminopentyldimethylphosphine.

4. A method as defined in claim 1 wherein said phosphine is bis(2-carboxyethyl)methylphosphine.

5. A method as defined in claim 1 wherein said electron acceptor is 2-hydroxyphenazine.

6. A method as defined in claim 1 wherein said electron acceptor is 3-nitrophthalic anhydride.

7. A method as defined in claim 1 wherein said electron acceptor is 3,5-trifluoromethylbenzoic acid.

8. A method as defined in claim 1 wherein said electron acceptor is p-benzoquinone.

9. A method as defined in claim 1 wherein said phosphine is dissolved in aqueous solution.

10. A method as defined in claim 9 wherein said electron acceptor is dissolved in said solution of said phosphine.

11. A method as defined in claim 1 wherein said developed silver halide element includes an imagewise distribution of a photographic image dye.

12. A method as defined in claim 1 wherein said silver halide element includes a layer of silver for filtering light during exposure.

13. A method of bleaching metallic silver which comprises treating a deposit of metallic silver with an aliphatic tertiary organic phosphine in the presence of an electron acceptor selected from 3-nitrophthalic anhydride, 3-nitrophthalic acid, 2,5-dinitrobenzoic acid, 2,4-dinitrophenylacetic acid 3-nitro-o-phthalic amide, mellitic acid, mellitic trianhydride, 2-hydroxyphenazine benzoquinone, dichlorodicyano-p-benzoquinone, tetrachloro-p-benzoquinone, 2,6-dimethyl-p-benzoquinone, tetracyano-p-benzoquinone, pyrazine, p-phenylenediimine, 3,5-trifluoromethyl benzoic acid, and 3-carboxy-5-nitrobenzotrifluoride at a pH above 7, said phosphine and electron acceptor being used in equimolar proportions and in substantially excess proportions relative to the quantity of said metallic silver.

14. A method of bleaching metallic silver which comprises treating a deposit of metallic silver with an aliphatic tertiary organic phosphine in the presence of atmospheric oxygen at a pH above 7, said phosphine being used in substantially excess proportions relative to the quantity of said metallic silver and said treated deposit being maintained in the presence of atmospheric oxygen at least until bleaching is effected.

* * * * *